US006257764B1

(12) United States Patent
Lantz

(10) Patent No.: US 6,257,764 B1
(45) Date of Patent: Jul. 10, 2001

(54) INSULATED SHIPPING CONTAINER, METHOD OF MAKING, AND ARTICLE AND MACHINE USED IN MAKING

(76) Inventor: Gary W. Lantz, 24282 Lysanda Dr., Mission Viejo, CA (US) 92691

( * ) Notice: Subject to any disclaimer, the term of this patent is extended or adjusted under 35 U.S.C. 154(b) by 0 days.

(21) Appl. No.: 09/228,156

(22) Filed: Jan. 11, 1999

Related U.S. Application Data

(62) Division of application No. 08/633,154, filed on Apr. 16, 1996, now Pat. No. 5,897,017.

(51) Int. Cl.[7] ..... B65D 30/10

(52) U.S. Cl. ..... 383/105; 383/107; 383/121; 383/907

(58) Field of Search ..... 383/104, 107, 383/121, 122, 126, 907, 105

(56) References Cited

U.S. PATENT DOCUMENTS

| | | | | |
|---|---|---|---|---|
| 3,613,933 | | 10/1971 | Pilz et al. . | |
| 3,799,386 | | 3/1974 | Madalin et al. . | |
| 4,136,141 | | 1/1979 | Bauer et al. . | |
| 4,368,819 | | 1/1983 | Durham . | |
| 4,658,567 | | 4/1987 | Arada . | |
| 4,671,424 | | 6/1987 | Byrns . | |
| 4,829,741 | * | 5/1989 | Langen | 383/107 X |
| 4,923,077 | | 5/1990 | Van Iperen et al. . | |
| 5,018,646 | * | 5/1991 | Billman et al. | 383/104 X |
| 5,186,350 | | 2/1993 | McBride . | |
| 5,261,554 | | 11/1993 | Forbes . | |
| 5,352,043 | * | 10/1994 | Takagaki et al. | 383/104 |
| 5,865,540 | * | 2/1999 | Derby et al. | 383/107 X |
| 5,897,017 | | 4/1999 | Lantz . | |
| 5,944,251 | * | 8/1999 | LaFleur | 383/121 X |

FOREIGN PATENT DOCUMENTS

| | | | | |
|---|---|---|---|---|
| 1207856 | * | 12/1965 | (DE) | 383/44 |
| 87648 | * | 10/1959 | (DK) | 383/107 |
| 30641 | * | 3/1960 | (FI) | 383/121 |
| 642989 | * | 7/1962 | (IT) | 383/121 |
| 5-330561 | * | 12/1993 | (JP) | 383/104 |

* cited by examiner

*Primary Examiner*—Jes F. Pascua
(74) *Attorney, Agent, or Firm*—Terry L. Miller

(57) ABSTRACT

An insulated shipping container includes a formed body of foamed polymer material. This formed body defines a chamber, an opening from the chamber outwardly to ambient, a transition surface surrounding this opening, and an exterior surface. Preferably, the chamber and exterior surface are both cylindrical prismatic shapes of like configuration so that a uniformly thick wall of insulative foamed polymer material is provided between the chamber and ambient. A single sheet of plastic is integrally bonded to the foamed polymer body such that it faces all of the chamber, the transition surface, and a substantial portion of the exterior surface of the container. In one embodiment of the container the remainder of the exterior surface of the container is faced with a separate sheet of plastic, and the two pieces of plastic cooperate to define an escape slit at which excess foamed polymer material escapes during formation of the container in a fixture. In another embodiment of the container this un-foamed plastic sheet faces all exterior surfaces of the foamed polymer material, including those which bound the chamber.

9 Claims, 8 Drawing Sheets

FIG. 1.
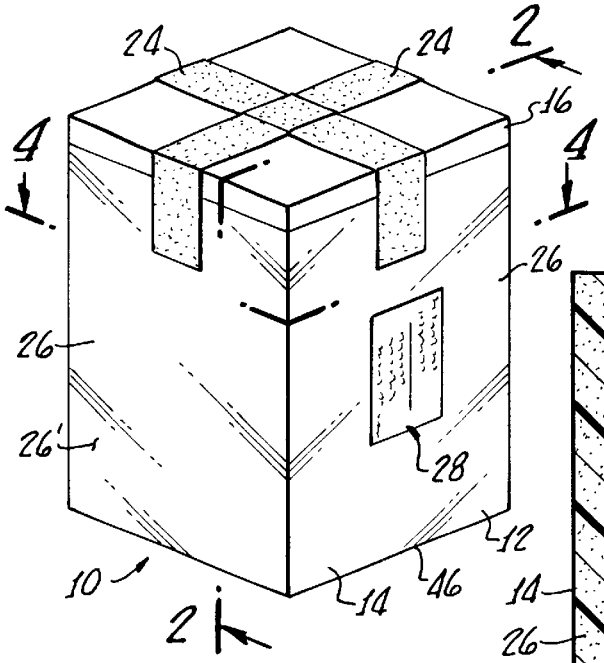
FIG. 4.
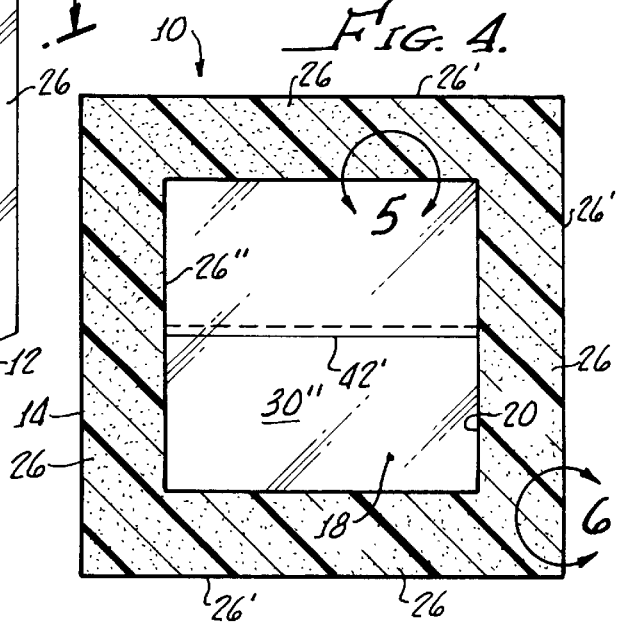
FIG. 2.
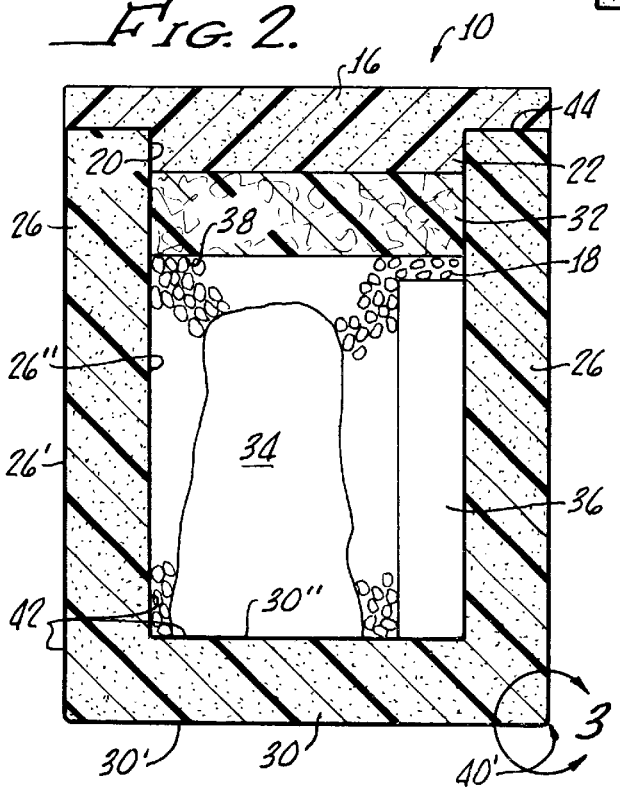
FIG. 3.
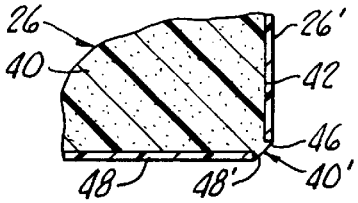
FIG. 5.
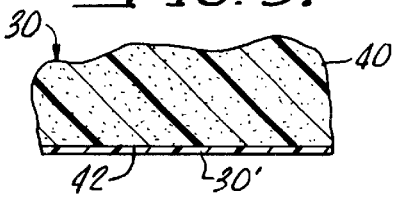
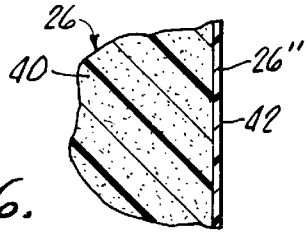
FIG. 6.

INSULATED SHIPPING CONTAINER, METHOD OF MAKING, AND ARTICLE AND MACHINE USED IN MAKING

RELATED APPLICATIONS

This application is a divisional of U.S. patent application Ser. No. 08/633,154, filed Apr. 16, 1996, now U.S. Pat. No. 5,897,017.

BACKGROUND OF THE INVENTION

1. Field of the Invention

The present invention is in the field of shipping containers. More particularly, the present invention relates to shipping containers which are insulated in order to maintain an article shipped in such containers at a refrigerated temperature for several days while the container and its contents are in shipment. Still more particularly, the present invention relates to such containers which are formed at least in part of foamed polymer material.

2. Related Technology

Conventional insulated shipping containers of the so-called box-within-a-box configuration are well known. These conventional box-within-a-box containers have an outer box formed of corrugated cardboard and a smaller inner open-topped box also formed of corrugated cardboard. These two boxes define a void space therebetween, which during manufacture of such shipping containers is filled with a foamed-in-place foamed polymer material. The favored polymer material for this use is light to medium density foamed polyurethane material.

During the manufacture of such box-within-a-box containers, the inner box is supported on a manufacturing fixture having a upstanding plug member over which the inner box is closely received in inverted position. Next, the outer box is inverted onto this manufacturing fixture with its top closure flaps turned outward, and its bottom closure flaps opened. The manufacturing fixture includes an outer movable wall structure which supports the side walls of the outer box. The polymer material in a liquid pre-foamed condition is sprayed into the void space between the two boxes, and foams in place. The foaming of this polymer material takes a sufficient interval of time that the bottom closure flaps of the box may be closed before the foam fills the void space, and a lid is closed over these closure flaps to support the box against the internal pressure created by the foaming polymer. As this polymer material foams in place, it bonds to both the inner and outer boxes and exerts a considerable pressure against both the inner and outer boxes. Were it not for the support to these boxes provided by the manufacturing fixture, the boxes would be seriously distorted or destroyed by the foam pressure. After an additional time interval (total time of a minute or less) the foam hardens sufficiently that the substantially finished shipping container may be removed from the fixture.

In the use of such conventional shipping containers, it is common to insert the article or articles to be shipped into the inner box along with a piece of dry ice and some loose-pack material, such as styrofoam peanuts, and to insert a form-filling cut piece of comparatively thick closed-cell foam sheet at the opening of the inner box. This closed-cell foam serves as a thermal insulator and prevents the infusion of warm ambient air or loss of chilled air from within the inner box, while also allowing the escape of carbon dioxide resulting from deliquescing of the dry ice. Next, the top closure flaps of the outer box are closed and taped, and the shipping container is ready from shipment with the attachment of a shipping label.

Unfortunately, this conventional insulated shipping container has several shortcomings. First, this conventional container is both labor and materials intensive to make. More seriously, the materials of this conventional container are not recyclable because the foamed polymer material bonds securely to the inner and outer cardboard boxes. Because these dissimilar materials are bonded together so securely that they can not be conveniently separated, most recycling facilities will not accept these containers. One suggestion for recycling these containers has been to use them as part of the fuel to an incinerator. However, the polyurethane polymer material represent air pollution concerns when so incinerated.

This shortcoming of the conventional insulated shipping containers is a serious concern with more and more states and countries requiring that shipping materials which have their destinations within their jurisdictions be recyclable, or be subject to a penalty taxation or fee for special disposal.

One suggestion which has been proposed to allow the separation of foamed polymer material and cardboard boxes of the conventional insulated shipping containers has been to simply bunch a flat sheet of plastic film within the outer box and over the inner box before the foam polymer material in a liquid form is injected. However, such an expedient results in the sheet plastic material forming folds and fissures in the excess sheet material. These folds and fissures too often form airflow pathways through which refrigerated air can escape from the container, and through which warm ambient air can enter. Also, the thickness of insulative foamed polymer material which is sometimes provided around the chamber of such insulated containers is uncontrolled and unreliable. As a result, some containers made by use of this expedient show areas where the insulating foam is too thin, and where in effect the refrigerated contents are exposed to "hot spots" of ambient heat leaking into the container. Because such insulated containers are frequently used to ship medical specimens or materials which are irreplaceable or critical to the health or life of a person, and which could be damaged or destroyed by a hot spot in the insulation around these materials in shipment, the risk is too great for such an unreliability container to be used.

In view of the deficiencies of the related technology, it is recognized as desirable to provide an insulate shipping container which is more time-efficient and material-efficient to make than the conventional insulated shipping container.

Another desirable feature for such an new insulated shipping container is for it to be totally recyclable.

SUMMARY OF THE INVENTION

As pointed out above, it is an object for the present invention to provide an insulated shipping container which is more time-efficient to make than the conventional insulated shipping container.

It is also an object for the present invention to provide an insulated shipping container which is more material-efficient to make than the conventional insulated shipping container.

Another object for such an new insulated shipping container is that it to be totally recyclable.

Accordingly, the present invention according to one aspect provides an insulated shipping container including a unitary prismatic body of foamed polymer material, the body defining a floor wall and plural side walls cooperatively defining a cylindrical cavity, an opening from the cavity, a transition surface surrounding the opening, and an exterior surface of the shipping container, the body further defining an integrally bonded un-foamed polymer sheet facing the cavity, the transition surface, and at least that portion of the exterior surface defined by the side walls.

An advantage of this invention is that the insulated shipping container is durable enough to endure several shipments, if desired. In the event that the container is to be used only one time, it is entirely recyclable.

The invention according to another aspect provides a plastic bag article of manufacture for use in making an insulated shipping container having a body of foamed polymer material substantially contained within the plastic bag article, the body of foamed polymer material defining a chamber therein and an opening outwardly from the chamber surrounded by a transition surface, the plastic bag article including a rectangular end portion; a curved transition section extending from the rectangular end portion to a transverse line at which the bag defines a hoop dimension sufficient to allow the bag to extend across the transition surface of the body of foamed polymer material.

According to another aspect, the present invention provides a method of making such a shipping container including steps of providing a body of foamed polymer material, and configuring the body to define a cylindrical chamber with an opening therefrom to ambient, a transition surface surrounding the opening, and a prismatic external surface; providing a sheet of un-foamed plastic material, and integrally bonding the sheet to the body of foamed polymer material so as to completely face the chamber.

An additional aspect of the present invention provides a plastic bag article of manufacture used in the method of making an insulated shipping container according to the present invention, and including a body of foamed polymer material substantially contained within the plastic bag article, the body of foamed polymer material. defining a chamber therein and an opening outwardly from the chamber surrounded by a transition surface, the plastic bag article including: a rectangular end portion having a transverse seam; the bag including a pair of spaced apart seams at opposite ends of and perpendicular to the transverse seam and at which a pair of blanks for the bag are joined to themselves; a pair of opposite side seams, each extending from a respective one of the pair of spaced apart seams in alignment with the transverse seam and extending to an open skirt edge of the plastic bag; and a curved transition section extending from the rectangular end portion to a transverse line intermediate the end portion and the skirt edge of the bag and at which the bag defines a hoop dimension sufficient to allow the bag to extend across the transition surface of the body of foamed polymer material.

Still additionally, the present invention provides a machine for use in making an insulated shipping container according to the present invention, and including: a base portion having an internal cavity and defining an upper surface; a source of vacuum connecting to the internal cavity of the base portion; a plug member matching in shape and size the internal chamber of the insulated shipping container and disposed upon the base member; a peripheral array of holes circumscribing the plug member and opening through the upper surface to the internal cavity of the base portion; an array of cooperative wall members hingeably attached to the base portion and in a first position hinging away from one another to leave the plug member exposed upon the base portion, the wall members hinging on the base member to a second position in which the wall members engage one another at adjacent edges and cooperatively define an enclosure surrounding the plug member in spaced relation thereto.

Additional features and advantages of the present invention may be appreciated from a reading of the following detailed description of several particularly preferred exemplary embodiments of the invention, taken in conjunction with the appended drawing figures, in which like reference numerals designate like features, or features which are analogous in structure or function.

BRIEF DESCRIPTION OF THE DRAWING FIGURES

FIG. 1 is a perspective view of an insulated shipping container according to the present invention;

FIG. 2 provides a cross sectional elevation view taken at line 2—2 of FIG. 1;

FIG. 3 is a greatly enlarged fragmentary cross sectional view of an encircled portion of FIG. 2;

FIG. 4 provides a cross sectional plan view taken at line 4—4 of FIG. 1, and with the contents of the shipping container removed to better illustrate features of the structure of the container;

FIGS. 5 and 6 are respective greatly enlarged fragmentary cross sectional views of an encircled portion of FIG. 4;

Figure 7:
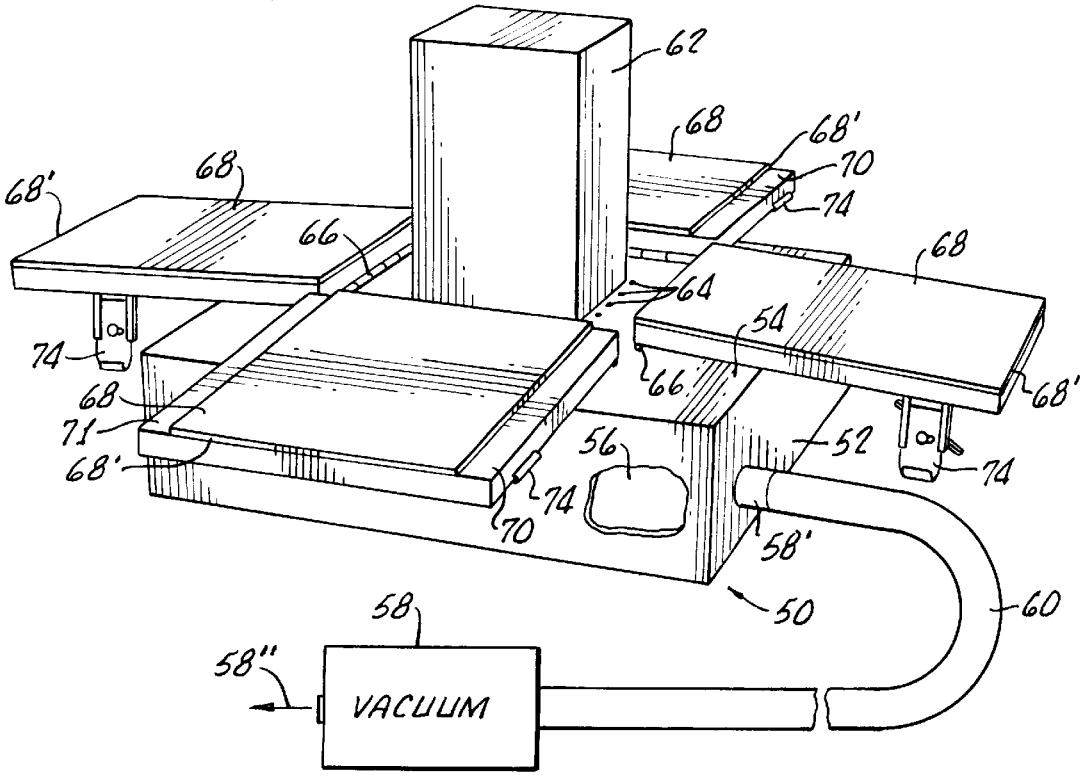
FIG. 7 is a perspective view of a machine used in the manufacturing of an insulated shipping container as seen in FIG. 1, and is in a condition preparatory to the beginning of this manufacturing process, but with a portion of the machine broken away to better illustrate the structure.
Figure 8:
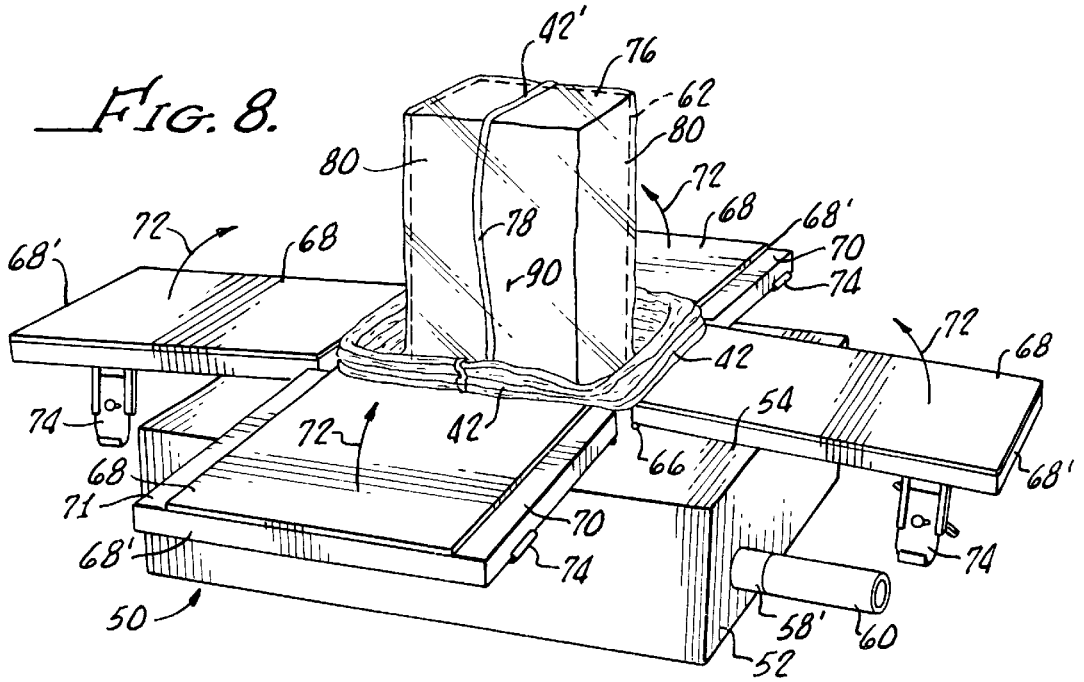
Figure 9:
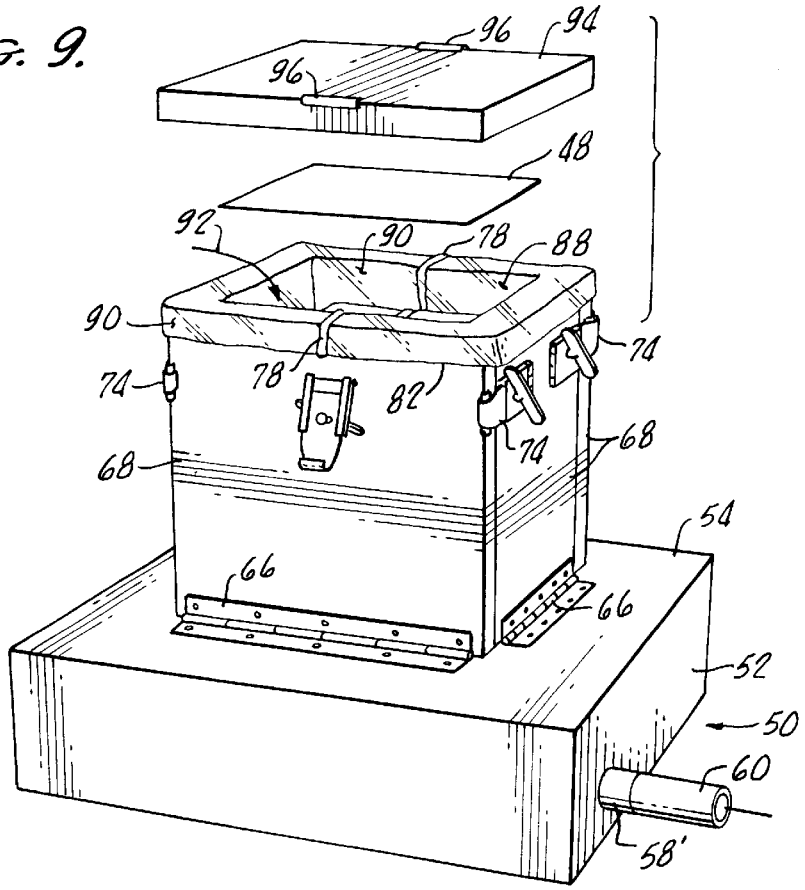
Figure 10:
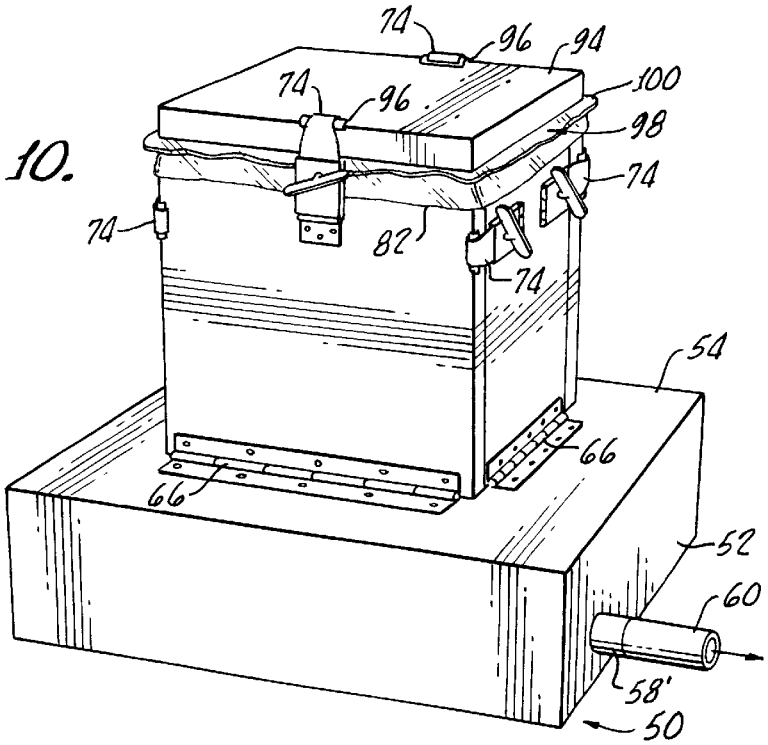
Figure 11B:
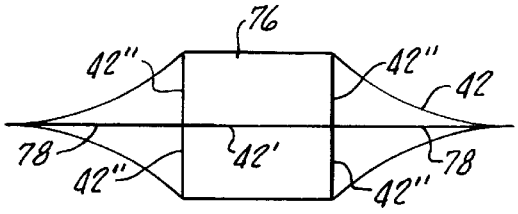
Figure 11A:
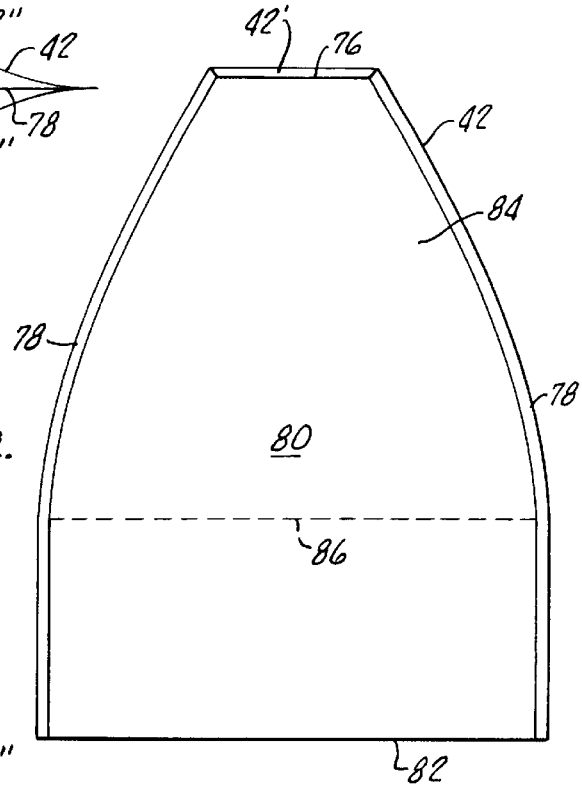
Figure 12:
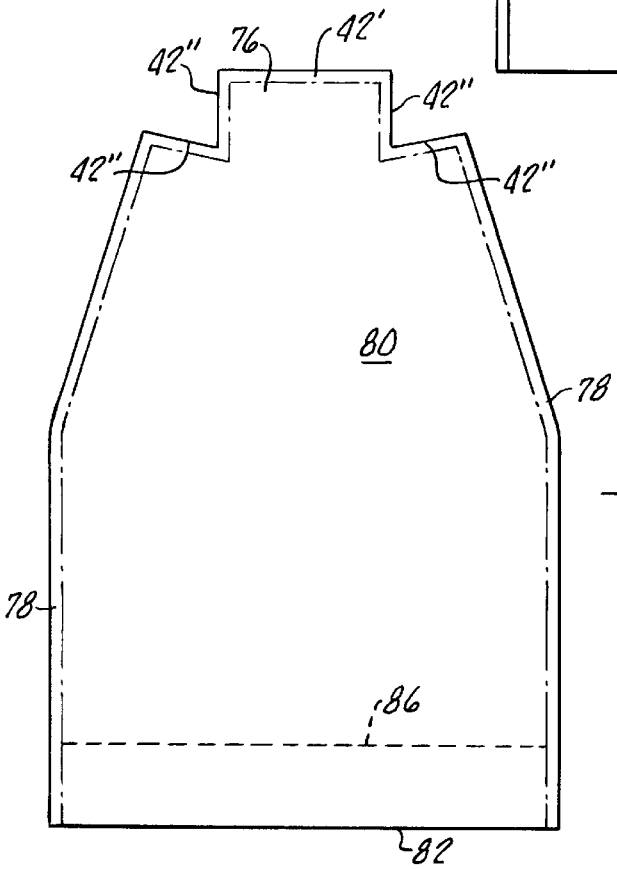
Figure 13:
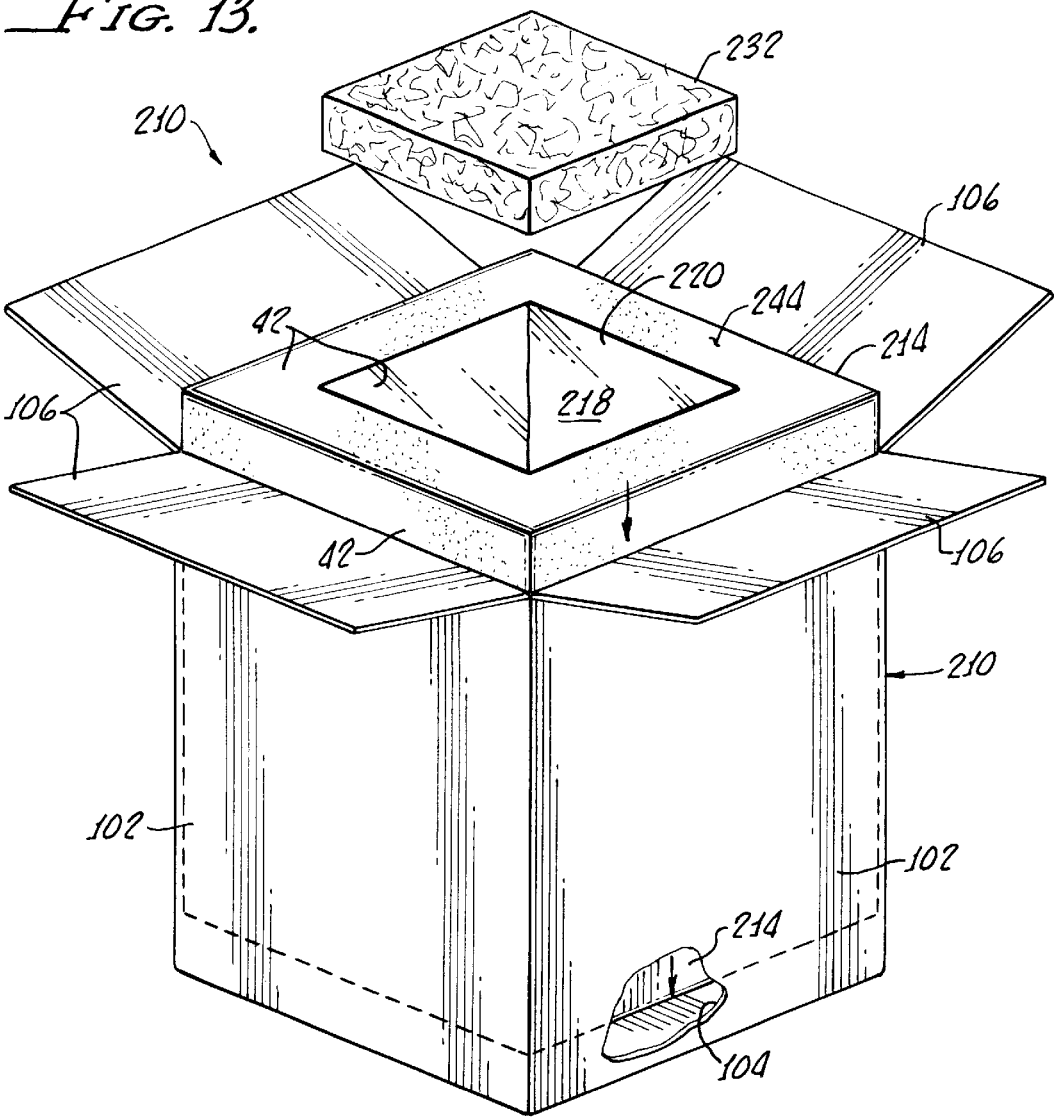
Figure 14:
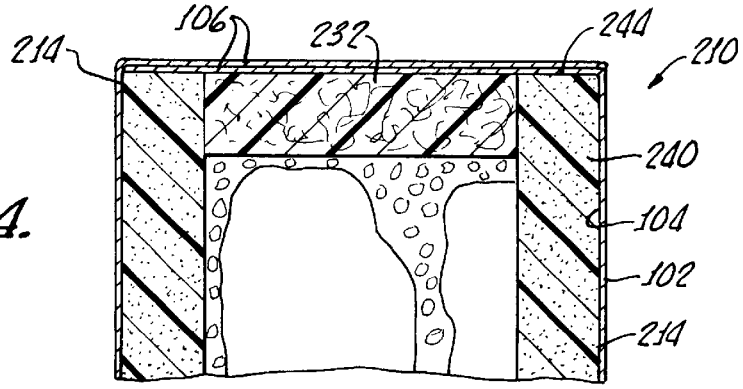

FIGS. 8, 9, and 10 are perspective views of the machine seen in FIG. 7 at successive stages in the manufacturing of an insulated shipping container as seen in FIG. 1, and also showing a plastic bag article of manufacture used in this manufacturing process;

FIGS. 11*a* and 11*b* are respective side and end views of the plastic/bag article of manufacture used in this manufacturing process;

FIG. 12 provides a plan view of a blank used in making the plastic bag article of manufacture seen in, FIGS. 11 and 12;

FIG. 13 provides a perspective view of an alternative embodiment of an insulated shipping container embodying the present invention preparatory to closure of this container;

FIG. 14 is a fragmentary cross sectional elevation view of the upper part of the alternative shipping container seen in FIG. 13.

Figure 15:
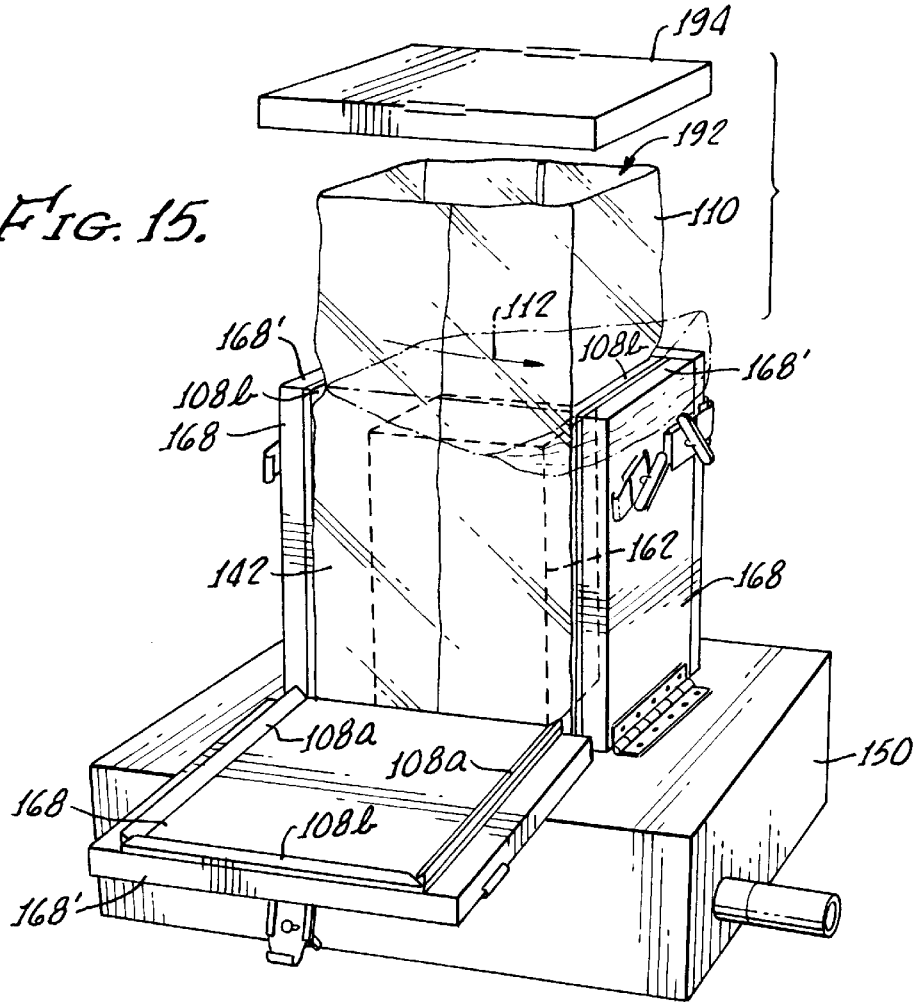
Figure 16:
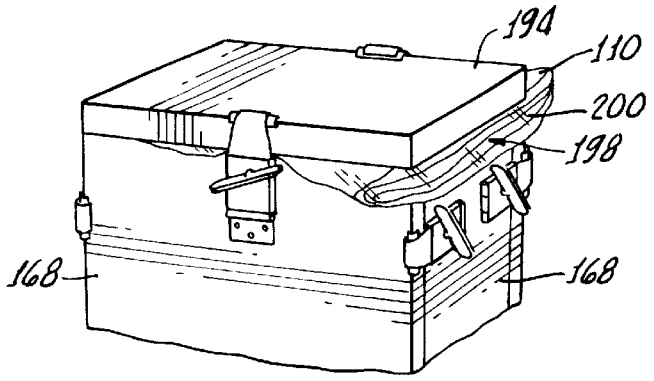
Figure 17:
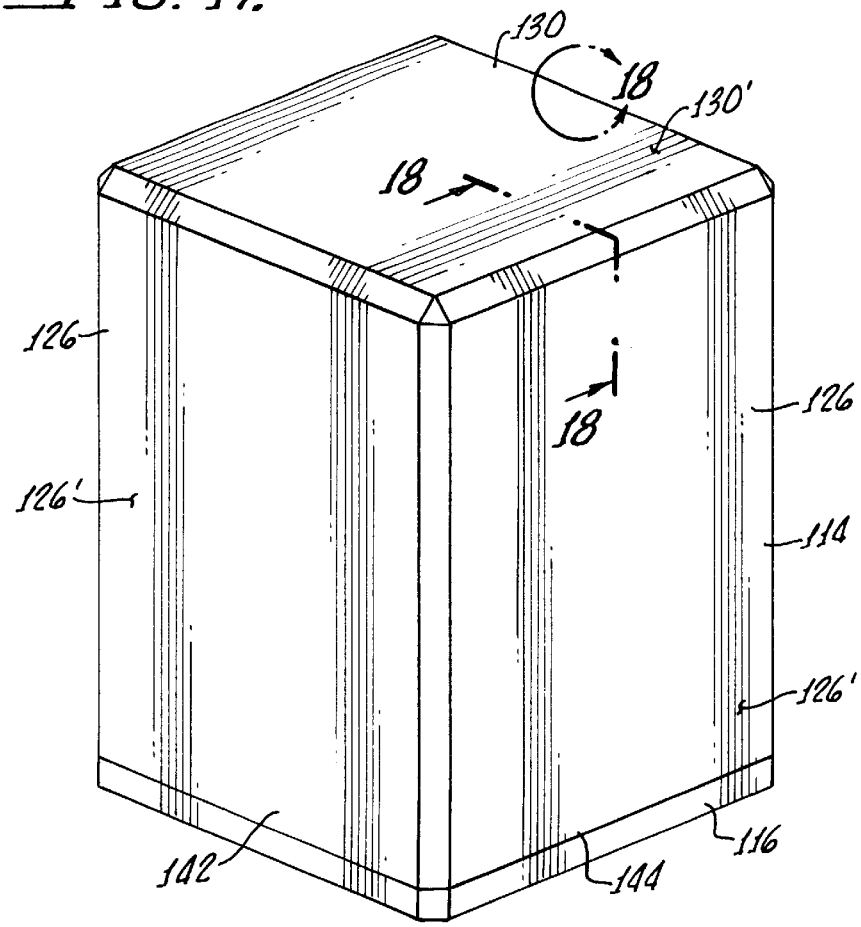
Figure 18:
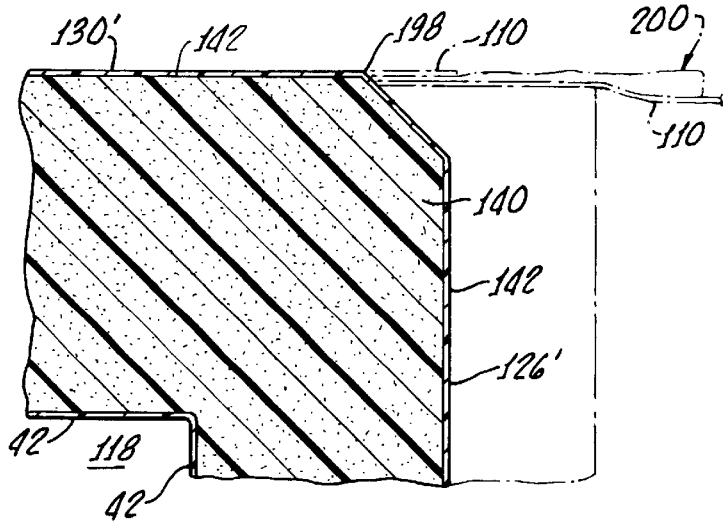
Figure 19B:
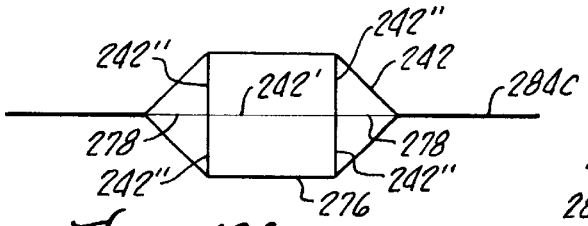
Figure 19A:
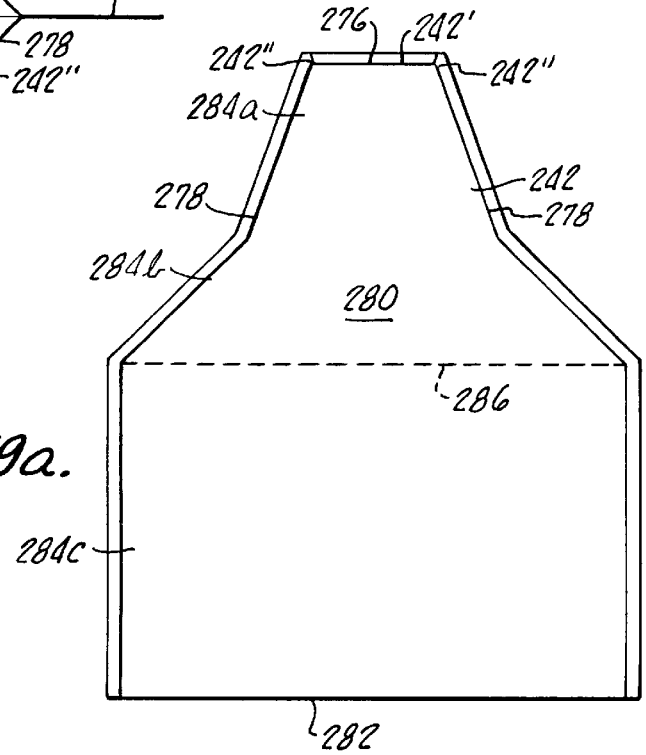
Figure 20:
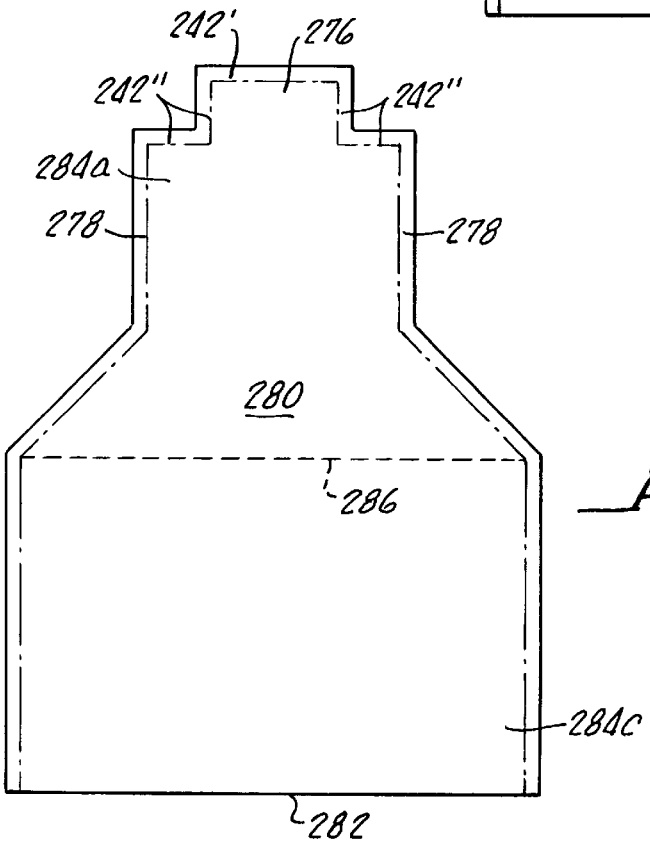

FIGS. 15, and 16 are perspective views of a machine similar to that seen in FIG. 7, but being used to make an alternative embodiment of the lower portion for a shipping container, and show successive stages in the manufacturing process for this container, and also showing an alternative embodiment of a plastic bag article of manufacture used in this manufacturing process;

FIG. 17 provides a perspective view of the alternative embodiment of the shipping container made according to the method and with the plastic bag article as seen in FIGS. 15 and 16;

FIG. 18 is a fragmentary cross sectional view of an encircled portion of FIG. 17, and is similar to FIG. 3 but shows the structure of the alternative embodiment of the shipping container;

FIGS. 19*a* and 19*b* are respective side and end views of an alternative plastic bag article of manufacture used in this manufacturing process; and FIG. 20 provides a plan view of a blank used in making the plastic bag article of manufacture seen in FIGS. 19*a* and 19*b*.

DETAILED DESCRIPTION OF THE PREFERRED EXEMPLARY EMBODIMENTS OF THE INVENTION

Viewing FIG. 1, an insulated shipping container 10 embodying the present invention is depicted in perspective view. The shipping container 10 includes a chambered prismatic body including a lower portion 14 and a lid 16. The lower portion 14 defines a cylindrical chamber 18 (best seen in FIGS. 2 and 4) and an opening 20 to this chamber. The chamber 18 has an interior perimeter dimension in plan view, as is best seen in FIG. 4. Also, as is seen in FIG. 4, the container 10 itself has an exterior perimeter dimension in plan view. The lid 16 matches the rectangular shape of the lower portion 14 in plan view, and includes an extension portion 22 generally matching the shape of and received into the upper extent of the chamber 18. Lid 16 may be made of any chosen material, such as styrofoam for example, but is preferably made of a foamed polymer material the same as that of the lower portion 14. As is shown in FIG. 1, a pair of adhesive tape strips 24 are crossed over the lid 16 and downwardly along the opposite side walls 26 of the lower portion 14. The side walls 26 have outer surfaces 261 and inner surfaces 26". Thus, the lid 16 is removably attached to the lower portion 14. A shipping label 28 may also be attached to one of these side walls 26.

As can be seen in FIG. 2, the lower portion 14 includes also a lower wall 30 defining a floor for the chamber 18, so that this chamber is closed with the lid 16 in place. The lower wall 30 has an outer surfaces 30' and inner surface 30". Within the chamber 18 is received a comparatively thick and form-fitted piece 32 of closed-cell foam sheet forming a thermal closure in the opening 20. That is, the piece 32 is cut to a size allowing its light force-fitting by hand into the opening 20 and chamber 18 at the top of the latter.

Within the remainder of chamber 18 is packed an article 34 to be shipped at refrigerated temperature (for example, a plastic bag containing a medical specimen or preparation), a piece of dry ice 36 for refrigeration, and a quantity of loose-fill packing material 38, such as styrofoam "peanuts." It will be noted that lid 16 is sufficiently loose fitting in opening 20 that no significant gas pressure differential is maintained between ambient and the interior of the container 10. Also, the thermal barrier member 32 is of closed-cell. nature so that ambient air does not permeate through this member, but carbon dioxide resulting from deliquescence of the dry ice 36 may escape chamber 18 past the edges of this member 32 and the inner surfaces 26" of walls 26 bounding chamber 18.

It will be noted viewing FIGS. 1–6 that the walls 26 and floor 30 are unitary with one another, and are defined by insulative foamed polymer material 40. Preferably, the foamed polymer material in this embodiment is medium-density foamed polyurethane, and is substantially rigid and shape-retaining. In order to provide protection from abrasion to this foamed polymer material 40, the walls 26 are faced on both their inner and outer surfaces 26' and 26" with an integral bonded sheet of un-foamed polymer sheet material 42. The sheet material 42 also faces the inner surface 30" of floor 30. In order to accomplish this protective facing for the container 10, a single piece of polymer sheet material 42 integrally faces the inner surface 30" of floor 30, extends upwardly from this floor along the inner surfaces 26" of side walls 26, extends outwardly across a transition surface 44 surrounding opening 20 (as is best seen in FIG. 2), and extends downwardly along the outer surfaces 26' of these walls. The sheet 42 terminates at an edge 46 adjacent to the bottom of the container 10 opposite to opening 20. Across the bottom surface of the container 10 (i.e., the outer surface 30" of wall 30 opposite to opening 20) a separate sheet 48 of un-foamed polymer sheet material is integrally bonded, and defines edges 48' adjacent to the edges 46. Between the edges 46 and 48' is exposed a very slim part 40' of the foam material 40, for a purpose which will become clear below. Before continuing with a consideration of how the container 10 is made, it will be noted that in the embodiment depicted, the sheet 42 includes a seam 42' seen in FIG. 4.

Turning now to FIGS. 7–10, a machine 50 for use in making the lower portion 14 of the container 10 is depicted. Machine 50 includes a hollow or chambered base portion 52 defining an upper surface 54, and a cavity 56 which is closed except as described below. A vacuum source 58 has a connection at 58' to the chamber 56, and is communicated therewith via a conduit or hose 60 to aspirate ambient air from this chamber. As is shown by the arrow 58", air is ejected from the cavity 56 so that this cavity is maintained at a partial vacuum while the vacuum source 58 is operated.

Disposed upon the upper surface 54 is a prismatic plug member 62 matching in shape and size the chamber 18 of lower portion 14 of container 10. Also on the upper surface 54 and opening to the cavity 56 is a peripheral array of comparatively small holes 64. The array of holes 64 circumscribes the plug member 62. Spaced from the plug member 62 and hingeably attached to the base member 52 by respective hinges 66 is an array of four wall members 68 which are facially of the same size and shape as the outer surfaces 26' of the lower portion 14 of container 10. The walls 68 are spaced from the plug member 62 by a distance equal to the thickness of the walls 26. Opposite ones of the walls 68 define rabbet edges 70 which engage the other two walls so that the four walls 68 can inter-engage one another in mutual supporting relationship, as will be seen. Each of the four walls 68 defines a respective upper edge surface 68' which are all at the same level as one another when the walls 68 are pivoted upwardly (as is indicated by arrows 72) so that the walls 68 inter-engage. The upper surface 68' is disposed above the top of plug 62 by about the same distance as the horizontal space between the plug 62 and walls 68. Walls 68 are provided with latching devices 74 so that they may be latched in an inter-engaging position.

Viewing FIG. 8, the machine 50 is shown with a plastic bag 42 in place on the plug member 62 in preparation to making a lower portion 14 of the container 10. As is seen in FIG. 8, a portion of the bag 42 is drawn by vacuum onto the upper surface 54 of base portion 52, and is also drawn tightly onto the plug member 62. The plastic bag 42 is one and the same as the sheet material 42 of lower portion 14 of container 10 as described above.

Before continuing with the consideration of machine 50, attention now to FIGS. 11*a*, 11*b*, and 12 to see the structure and configuration of bag 42. As is seen in FIG. 11, the bag 42 includes a rectangular end portion 76 defining seam 42', and opposite seams 42" perpendicular to seam 42'. The end portion 76 is received on the upper end of plug member 62, and defines the inner surface 30" of lower wall 30 of the lower portion 14 of container 10, recalling the description above. The bag 42 includes side seams 78 aligned with and continuing from seam 42' such that the bag 42 is formed from two identical flat blank members 80, one of which is seen in FIG. 12. On the blank of FIG. 12, the same numerals are used to indicate features which will become correspondingly numbered features of the bag 42. As is indicated on FIG. 12, the rectangular end portion 76 of the bag 42 is formed by a corresponding protrusion 76 at the end of the blank 80. The seams 42" are formed by joined together edges 42" at the side of the protrusion 76 and at what may be termed a pair of adjacent angulated "shoulders" for the blank 80. Seam 42' is formed by joining the edges 42' of two blanks, and side seams 78 are formed by joining the edges indicated with numeral 78 on the two blanks. An end edge 82 of the blanks together forms an open skirt (also indicated with the numeral 82, viewing FIG. 11*a*.

As FIG. 8 shows, the bag 42 is received over the plug member 62, and is gathered by vacuum to fit closely on this plug member. The bag 42 includes a curved transition section 84 such that its hoop dimension indicated at a line 86 is sufficient to allow the bag to extend across the upper surface 54 of the machine 50 in order to cover the surface 44 of the lower portion 14, recalling the description above. Also bag 42 continues to flare slightly beyond transition section 84 toward the open edge 82 such that the bag 42 can be turned down over the top edge 68' of the inter-engaged walls 68, viewing now FIG. 9. Consideration of FIG. 9 shows that the bag 42 defines a circumferential cavity 88 within the walls 68 and around plug member 62. The surface 90 of the bag member which faces cavity 88 is treated by ozone exposure or by plasma exposure so that the polymer material 40 can bond to this surface 90. As is indicated on FIG. 9 by the arrow 92, liquid pre-foam material for the polymer 40 is injected into the cavity 88 in a measured quantity. Immediately after the injection of the liquid pre-foam polymer material 92, a sheet 48 of polymer material is drawn across the open upper edges 68' of the cavity 88, and a lid 94 is closed on this opening and held in place by clamp devices 96. The lid 94 is sized to provide opposite escape slots 98 (best seen in FIG. 10).

FIG. 10 shows that the liquid pre-foam polymer material foams up to produce foam 40, a small excess amount 100 of which escapes from the cavity 88 via the slots 98. During this foaming, the material 40 is exothermic, exerts pressure on the walls 68 firmly engaging the sheet material of bag 42 with these walls, and also bonds integrally with the surface 90 of the bag 42. After an interval of time, which is usually less than one minute, the foam material 40 is sufficiently cured that it is self-supporting, and the lid 94 and walls 68 may be unlatched from one another. At that time, the lower member 14 for container 10 may be lifted off of the plug member 62. The only finishing necessary for this lower member 14 is the trimming of the excess foam material 100, leaving exposed foam surface 40, recalling FIG. 3. This trimming can be done manually, with a razor knife for example. It will be noted that the bag 42 serves as a release sheet between the foam 40 and machine 50, while the configuration of the bag prevents formation of folds or fissures which could provide air flow paths compromising the insulation value of the container. The lid 16 may be formed similarly with a plastic sheet outer surface for abrasion resistance and may be a "bare" foam.

Viewing now FIGS. 13 and 14, an alternative combination with lower portion 14 in order to provide an insulated shipping container is depicted. In order to obtain reference numerals for use in describing this alternative embodiment of the invention, features which are the same as, or which are analogous in structure or function to those described above are indicated with the same numeral used above, and increased by two-hundred (200). Thus, in FIGS. 13 and 14 the lower portion 14 is indicated with numeral 214. As is indicated in FIGS. 13 and 14, in order to provide a complete shipping container 210, the lower portion 214 is slipped into a cardboard box 102, which box is sized to have a cavity 104 slidably and removably receiving the lower portion 214. As shown in FIG. 13, the lower portion 214 is shown slightly elevated relative to its final position to show that it is slidable in the box 102, as is depicted by the arrow along the side of member 214. Preferably, the box 102 is sized such that its upper closure flaps close immediately above the flexible open-cell foam member 232 (i.e., immediately above transition surface 244, as is shown in FIG. 14). In order to retain the flexible open-cell foam member 232, the upper closure flaps 106 are closed over this member after the contents and a piece of dry ice or other refrigeration provision are placed into the chamber 218. Upon receipt of the package 210, the foam lower portion 214 is simply slipped out of the cardboard box 102, and the box and foamed polymer are recycled separately.

Turning now to FIGS. 15, 16, 17, and 18, steps in the method of making an alternative embodiment of the lower portion 14 for an insulated shipping container similar to that described above, and using a similar machine, are depicted. FIGS. 17 and 18 illustrate the container produced. In order to obtain reference numerals for use in describing this alternative embodiment of the machine, bag, and insulated container, features which are the same as, or which are analogous in structure or function to, those features described above are referenced with the same numeral used above, and increased by one-hundred (100).

Viewing FIG. 15, the machine 150 is shown with a plastic bag 142 in place on the plug member 162 in preparation to making a lower portion 114 of the container 110. As seen in FIG. 15, one of the wall portions 168 has not yet been closed to cooperate with the other walls 168. It will be understood that the one open wall portion 68 will be closed and latched into cooperation with the other walls before the pre-foam liquid 188 is injected. The one open wall 168 in FIG. 15 illustrates that in this case the insulated container to be made (partially depicted in FIGS. 17 and 18) is provided with chamfered outer corners by providing angular fillets 108 on the inside of the walls 168. That is, the one side wall 168 which is open, and the opposite wall 168 each carry both a pair of spaced apart side fillets 108*a,* and a top fillet 108*b*. As is seen in FIG. 15, the other side walls 168 simply carry a top fillet 108*b*.

Also as is seen in FIG. 15, the bag 142 for this embodiment of the lower portion 114 for container 110 is considerably longer than that illustrated in FIG. 9. As is seen, the bag 142 includes a skirt portion 110, which is long enough that it extends above the top edge 168' of the side walls 168 by an amount that at least slightly exceeds the spacing between opposite ones of the side walls 168. Consequently, as is indicated by the arrow 112 in FIG. 15, after the pre-foam liquid (arrow 192) is injected into cavity 188, the bag skirt 110 can be swept or folded across the top of the cavity 188 to one side. Then immediately the lid 194 is put in place and latched to the walls 168. The result is that the bag 142 at skirt 110 is held between the top of one side wall 168 and the lid 192, defining a foam escape slot at 198.

FIG. 16 shows the machine 150 in the condition as described above, with an escaping portion of foam 200 from slot 198. FIGS. 17 and 18 show the resulting lower portion 114 for the container 110 (in an inverted position). This lower portion 114 has chamfered corners, as explained above. Further, in this case, in addition to facing the chamber 118, transition surface 144, and the side surfaces 126', the sheet of plastic 142 (which was bag 142 seen in FIG. 15) now also faces the bottom surface 130' of wall 130. As is seen in FIG. 18, the only exposed portion of foam 140 occurs at the escape slot 198, and is the result of the trimming off of the excess skirt of bag 142 and the scrap foam 200, seen in FIG. 16, and indicated on FIG. 18 in phantom lines. The result is that the lower portion 114 for insulated container 110 made according to this embodiment of the invention has all exterior surfaces of the foam body 112 (including those bounding the chamber 18) faced with a single substantially continuous sheet of plastic.

With both embodiments of the lower portion 14 (or 114) presented above, and considered topographically, it is seen that the sheet 42 or 142 of plastic (which was the bag 42 or 142) in the first case is closed with the cooperation of sheet 48 along the slots 98 (i.e., at 40' seen in FIG. 3), and in the second case is substantially closed on itself along the slot 198 seen in FIG. 18. There is also some inevitable wrinkling of the sheet material of bags 42 and 142. Some of these wrinkles with be inward, and are locked into the foam 40 or 140 so that: they appear on the exposed surfaces of lower portion 114 as creases. Those wrinkles in the bags 42 and 142 which are outward with respect to the foam 40 and 140 may result in outwardly projecting fins of plastic sheeting. These fins of plastic sheeting which are of sufficient size or which are loose at one or both ends are simply trimmed off at the same time the skirt 110 and excess foam 100 or 200 is trimmed. However, the foam polymer material 40 and 140 adheres so tenaciously to the sheet material 42 and 142 (which was the bags 42 and 142), that trimming these fins of plastic sheet does not significantly expose the foam 40 or 140, nor allow the sheet material to peal from the foam body. Consequently, in each embodiment presented, the entire outer face of the foamed polymer body is faced with plastic sheeting. In the embodiment shown in FIGS. 15–18, the entire exposed outer surface of the foam body 112 is faced with a single sheet of plastic.

FIGS. 19*a,* 19*b,* and 20 illustrate an alternative embodiment of the plastic bag article, and are similar to FIGS. 11*a,* 11*b,* and 12, respectively. In order to obtain reference numerals for use in describing this alternative embodiment, the numerals used above are used to reference the same or analogous features and are increased by two-hundred (200) on FIGS. 19*a,* 19*b,* and 20. As is seen in FIGS. 19*a* and 19*b,* the alternative bag 242 includes a rectangular end portion 276 defining seam 242', and opposite seams 242" perpendicular to seam 242'. The end portion 276 is received on the upper end of plug member 62 of the machine 50, recalling the description above, and defines the inner surface 30" of lower wall 30 of the lower portion 14 of container 10. The bag 242 includes side seams 278 aligned with and continuing from seam 242' such that the bag 242 is formed from two identical flat blank members 280, one of which is seen in FIG. 20. On the blank 280 of FIG. 20, the same numerals are used to indicate features which will become correspondingly numbered features of the bag 242. As is indicated on FIG. 20, the rectangular end portion 276 of the bag 242 is formed by a corresponding protrusion 276 at the end of the blank 280. The seams 242" are formed by joined together edges 242" at the side of the protrusion 276 and at what may be termed a pair of adjacent slightly angulated "shoulders" for the blank 280. Seam 242' is formed by joining the edges 242' of two blanks, and side seams 278 are formed by joining the edges indicated with numeral 278 on the two blanks 280. An end edge 282 of the blanks together forms an open skirt (also indicated with the numeral 282, viewing FIG. 19*a*. The bag 242 includes a first triangular neck section 284*a* leading to a second triangular more broadly flaring transition section 284*b* such that its hoop dimension indicated at a line 286 is sufficient to allow the bag 242 to extend across the upper surface 54 of the machine 50 in order to face the surface 44 of the container lower portion 14, recalling the description above. Also bag 242 includes another almost straight and cylindrical section 284*c,* which provides material to face the outer surfaces 26' of the side walls 26, recalling the description above.

While the present invention has been depicted, described, and is defined by reference to particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiments of the invention are exemplary only, and are not exhaustive of the scope of the invention. Consequently, the invention is intended to be limited only by the spirit and scope of the appended claims, giving full cognizance to equivalents in all respects.

I claim:

1. A plastic bag article of manufacture with a closed end portion having a first hoop dimension, an opposite open end, and a transition section of second hoop dimension greater than said first hoop dimension, said plastic bag article being turned back on itself with the closed and open ends in juxtaposition so that said plastic bag article provides an annular space between spaced apart inner and outer wall portions of said transition section, said plastic bag article being for use in making an insulated container having a body of foamed polymer material substantially contained between said spaced apart inner and outer wall portions of said plastic bag article, said body of foamed polymer material defining a chamber therein having an end surface defining an interior perimeter dimension and an opening outwardly from said chamber, said opening being surrounded by a transition surface defining an exterior perimeter dimension, said plastic bag article comprising:

said end portion defining said respective first hoop dimension which is substantially equal to but greater than said interior perimeter dimension;

said transition section having a wall portion extending from said end portion to a transverse line at which said plastic bag article defines said second hoop dimension which is substantially equal to but greater than said exterior perimeter dimension and which is sufficient to allow said plastic bag article when turned back on itself to extend across said transition surface of said body of foamed polymer material.

2. The plastic bag article of manufacture according to claim 1 wherein said plastic bag article further includes a skirt portion flared beyond said transverse line of second hoop dimension such that said plastic bag article defines a third and larger hoop dimension at said open end thereof.

3. A plastic bag article of manufacture for use in making an insulated container having a body of foamed polymer material substantially contained between spaced apart inner and outer wall portions of said plastic bag article, said body of foamed polymer material defining a chamber therein having a closed end surface at which said chamber defines an interior perimeter dimension, and an opening outwardly from said chamber, said opening being surrounded by a transition surface defining an exterior perimeter dimension, said plastic bag article comprising:

an end portion defining a respective first hoop dimension which is substantially equal to but greater than said interior perimeter dimension;

a first triangular neck section extending from said end portion to a second triangular more broadly flaring transition section, said second triangular more broadly flaring transition section extending to a transverse line at which said plastic bag article defines a second hoop dimension which is substantially equal to but greater than said exterior perimeter dimension, said plastic bag article also including a substantially straight skirt section extending from said transverse line to and defining an open end for said bag.

4. A plastic bag article of manufacture for use in making an insulated container having a body of foamed polymer material substantially contained within said plastic bag article, said body of foamed polymer material defining a chamber therein having an end surface defining an interior perimeter dimension and an opening outwardly from said chamber, said opening outwardly from said chamber being surrounded by a transition surface defining an exterior perimeter dimension, said plastic bag article comprising:

an end portion having a transverse seam and defining a respective first hoop dimension which is substantially equal to but greater than said interior perimeter dimension;

said plastic bag article including a pair of spaced apart seams at opposite ends of and perpendicular to said transverse seam;

a pair of opposite side seams, each extending from a respective one of said pair of spaced apart seams in alignment with said transverse seam and extending to an open skirt edge of said plastic bag article; and a transition section extending from said end portion to a transverse line intermediate said end portion and said skirt edge of said plastic bag article, and at which said plastic bag article defines a second hoop dimension which is substantially equal to but greater than said exterior perimeter dimension, and which is sufficient to allow said plastic bag article to extend across said transition surface of said body of foamed polymer material.

5. A plastic bag article of manufacture for use in making an insulated container having a body of foamed polymer material substantially contained within said plastic bag article, said body of foamed polymer material defining a chamber therein with an end surface defining an interior perimeter dimension and an opening outwardly from said chamber, said opening outwardly from said chamber being surrounded by a transition surface defining an exterior perimeter dimension, said plastic bag article comprising:

an end portion having a transverse seam and defining a respective first hoop dimension which is substantially equal to but greater than said interior perimeter dimension;

said plastic bag article including a pair of spaced apart seams at opposite ends of and perpendicular to said transverse seam;

a pair of opposite side seams, each extending from a respective one of said pair of spaced apart seams in alignment with said transverse seam and extending to an open skirt edge of said plastic bag; and a first triangular neck section extending from said end portion to a second triangular more broadly flaring transition section at which said plastic bag article defines a second hoop dimension which is substantially equal to but greater than said exterior perimeter dimension, said second triangular more broadly flaring transition section leading to a substantially straight skirt section defining an open end for said bag article at which said plastic bag article defines said open skirt edge.

6. A blank for making a plastic bag article of manufacture which includes a rectangular end portion and a flaring curved skirt extending from said end portion to an open skirt edge of said bag, said bag being for use in making an insulated shipping container, said blank comprising:

a piece of sheet plastic material configured to include a rectangular protrusion portion at an end thereof, said protrusion defining a pair of opposite edges, and said blank defining a pair of oppositely extending angulated shoulder edges adjacent to said protrusion and one on each side thereof, said shoulder edges each being of like length to and joinable with a respective side edge of said protrusion, and said blank including a pair of opposite curved transition edge portions extending from adjacent said pair of shoulders toward a skirt edge of said blank which is spaced from said protrusion portion;

whereby a pair of said blanks are joined to one another in face-to-face relation to define said plastic bag article having said rectangular end portion and said flaring curved transition portion extending from said end portion toward a open skirt end of said bag.

7. A blank for making a plastic bag article of manufacture which includes a rectangular end portion and a flaring curved skirt extending from said end portion to an open skirt edge of said bag, said bag being for use in making an insulated shipping container, said blank comprising:

a piece of sheet plastic material configured to include a rectangular protrusion portion at an end thereof, said protrusion defining a pair of opposite edges, and said blank defining a pair of oppositely extending angulated shoulder edges adjacent to said protrusion and one on each side thereof, said shoulder edges each being of like length to and joinable with a respective side edge of said protrusion, and said blank including a substantially straight neck section extending to a triangular flaring transition section leading to a substantially straight skirt section at which said bag article will define an open end;

whereby a pair of said blanks are joined to one another in face-to-face relation to define said plastic bag article having said rectangular end portion and said substantially straight neck section, said triangular flaring transition section, and said substantially straight skirt section extending to said open end of said bag.

8. A flaring plastic sac for use in making a container including a body of foamed polymer material, said body of foamed polymer material having an interior cylindrical chamber with a floor defining an interior perimeter dimension, at least one side wall extending from said floor to and at an upper end defining an opening on said container outwardly from said interior chamber, said side wall defining a transition surface extending outwardly from said opening and having an exterior perimeter dimension, and said body of foamed polymer material being substantially encased within and bonding to said plastic sac, which plastic sac forms both an interior and exterior bonded skin on said container, said plastic sac comprising:

a plastic sheet having a pair of opposite faces, at least one of said pair of opposite faces being exposed to a material selected from the group consisting of plasma and ozone; so that said plastic sheet at said at least one of said pair of opposite faces bonds to said body of foamed polymer material, said plastic sheet at the other of said pair of opposite faces outwardly skinning said insulated container, said plastic sheet forming a flaring plastic sac with an end portion, said end portion defining a first hoop dimension which is substantially equal to but greater than said interior perimeter dimension; said plastic sheet further forming a flaring skirt portion of said sac extending from said end portion toward an opening for said sac, and with said skirt portion including a transition section of said sac which at a transverse line defines a second hoop dimension, said second hoop dimension being substantially equal to but sufficiently greater than said exterior perimeter dimension so as to allow said sac at said transition section and transverse line to extend across said transition surface of said body of foamed polymer material.

9. A flaring plastic sac which is especially configured to have a tubular body with an end wall portion providing a closed end for said flaring plastic sac, and a side wall forming a skirt portion extending from said end wall to and at a termination edge defining an open end for said flaring plastic sac, at least one face of said plastic sac being exposed to a material selected from the group consisting of plasma and ozone so that said plastic sac at said at least one face is bondable to foamed polymer material, said skirt portion flaring as it extends from said end wall portion to said open end such that the tubular body can be turned back on itself with said at least one face confronting itself to provide spaced apart inner and outer portions of said side wall which are bondable to said foamed polymer material, and with said end wall portion within generally juxtaposed to said open end, said end wall portion having a first hoop dimension, and at a selected transverse location intermediate of said end wall portion and said open end said skirt providing a second hoop dimension which is substantially greater than said first hoop dimension; such that said plastic sac can be used in making an insulated container skinned both internally and externally by said plastic sac as well as being floored by said end wall portion of said plastic sac, said insulated container having a body formed substantially of foamed polymer material which is received between said spaced apart inner and outer wall portions of said plastic sac with the body of foamed polymer material also including an end wall carrying said end wall portion of said plastic sac.

* * * * *